US006643872B1

(12) United States Patent
Buswell

(10) Patent No.: US 6,643,872 B1
(45) Date of Patent: Nov. 11, 2003

(54) COMFORTER WITH DUAL WARMTH CHARACTERISTICS DESIGNED FOR CONVENIENT RE-ORIENTING IN ANY DIRECTION

(75) Inventor: Renae Buswell, P.O. Box 313, Winlock, WA (US) 98596

(73) Assignee: Renae Buswell, Winlock, WA (US)

( * ) Notice: Subject to any disclaimer, the term of this patent is extended or adjusted under 35 U.S.C. 154(b) by 0 days.

(21) Appl. No.: 10/140,804

(22) Filed: May 6, 2002

(51) Int. Cl.[7] ..... A47G 9/02
(52) U.S. Cl. ..... 5/486; 5/502; 5/482
(58) Field of Search ..... 5/482, 486, 502, 5/907, 785, 500

(56) References Cited

U.S. PATENT DOCUMENTS 2,808,596 A * 10/1957 Schreiner ..... 5/486
5,007,125 A * 4/1991 Owenby ..... 5/486
5,199,121 A * 4/1993 Payne ..... 5/502
5,299,333 A * 4/1994 Pedersen et al. ..... 5/502
5,708,995 A * 1/1998 Wu et al. ..... 5/486
5,720,058 A * 2/1998 Hollander et al. ..... 5/502
6,122,781 A * 9/2000 Stephenson ..... 5/482
6,230,341 B1 * 5/2001 Dudley ..... 5/482
6,301,730 B1 * 10/2001 Delfs et al. ..... 5/502

FOREIGN PATENT DOCUMENTS

GB 2198940 A * 6/1988

* cited by examiner

*Primary Examiner*—Michael F. Trettel

(57) ABSTRACT

A comforter having dual warmth characteristics is provided. An internal median line of the comforter creates a division of two halves, both resembling its counterpart in appearance but differing in warmth retentiveness, providing either a greater warmth for the lower extremities of its occupant(s) than for their upper body or when oriented differently, a portion for a second occupant which is warmer than the portion for the first, and also providing a comforter that a single occupant could simply switch which side he was under as a means for regulating warmth depending on the surrounding temperature.

8 Claims, 2 Drawing Sheets

COMFORTER WITH DUAL WARMTH CHARACTERISTICS DESIGNED FOR CONVENIENT RE-ORIENTING IN ANY DIRECTION

BACKGROUND OF THE INVENTION.

Comforters have been altered in many ways, different embodiments providing for different levels of warmth for the lower extremities, and others providing different warmth for multiple occupants. But none unto now have provided for both.

In addition to not being previously disclosed, said invention has gained an increasingly wide market, as the measurements of the various sizes of mattresses across the nation are not only being shaved or added to in surface measurements, but also varying greatly in depth. Thus, comforters and sheets which are intended to be specific in their longitudinal and lateral draping over the sides of the mattress, are now often unable to fit just as intended for any size rating of bed. For example, a Double bed, generally measuring 54" in width by 75" in length from most manufacturers, may be 57" by 74" from another each with different mattress depths as well! So, a more universal, square comforter, such as that disclosed herein, is increasingly viable.

U.S. Pat. No. 5,708,995 to Wu provides a comforter with different warmth characteristics for two occupants with a light side, a warm side, and a transitional area between, with specific stacked layers.

U.S. Pat. No. 5,007,125 to Owenby details a comforter which provides a warmer lower portion than the upper portion.

U.S. Pat. No. 3,508,284 to Marquette describes a comforter using a one-weave manufacturing process with two halves of different warmth characteristics for two occupants.

None of these, nor other patents, however, provide all that the disclosed invention offers, nor the versatility of this invention.

SUMMARY OF THE INVENTION.

It is an object of the present invention to provide a comforter which has dual warmth characteristics, which may be oriented in any direction without loss of comfort or coverage, thus providing extra warmth for the lower extremities or for a second occupant according to user's preference It is another object of the present invention to provide a comforter which is aesthetically pleasing, having the appearance of a "normal" comforter by having a similar thickness and appearance across the exterior of the comforter, the evidence of the two halves being only the chosen method used to indicate them.

It is a further object of the present invention to provide a comforter which more universally fits bed sizes that are slightly different in measurements than what is typical.

BRIEF DESCRIPTION OF THE DRAWINGS

The invention as set forth in the appended claims is regarded as the invention. A better understanding of said invention may be had when taken in conjunction with the following description and accompanying drawings, in which like numerals refer to like parts throughout, and in which:

DESCRIPTION OF THE PREFERRED EMBODIMENTS

The following is a description of the preferred embodiments of the present invention in specifically detailed form, not intending to limit the scope of the claims, but rather as a means of expressing the invention in its most practical and preferred form.

Figure 2:
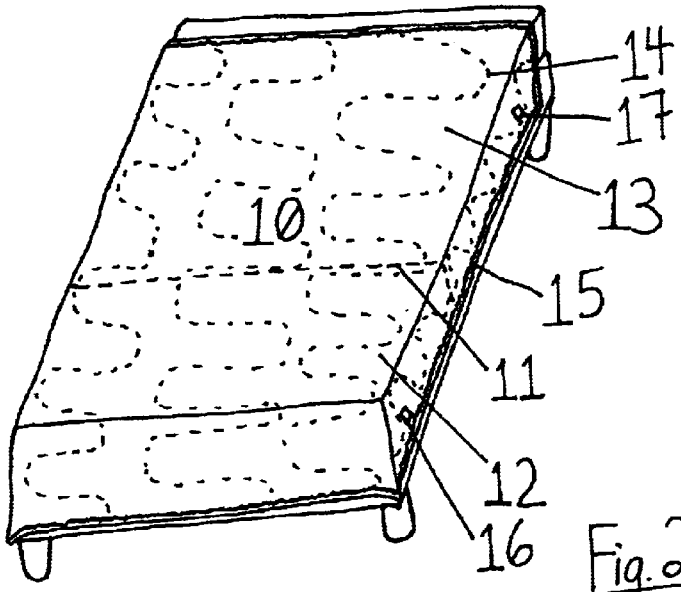
FIG. 2 is a perspective view of the comforter in its preferred embodiment, as it would appear covering a standard Queen mattress, with dimensions equivalent to actual measurements, with comforter oriented so as to provide differing thermal characteristics to the upper and lower halves.
Figure 3:
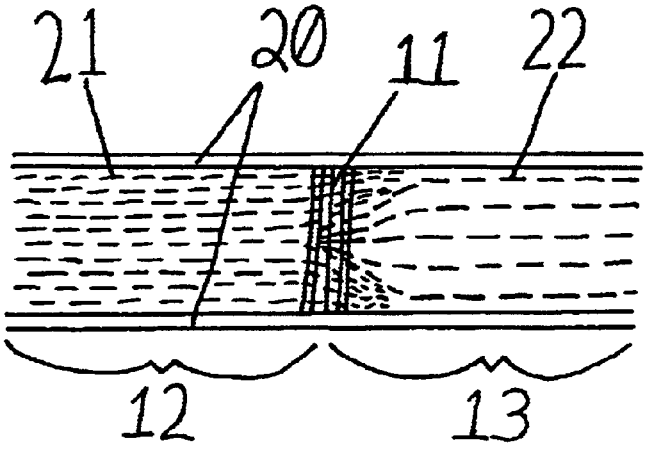
FIG. 3 is an enlarged partial cross-sectional view of the centerline of the comforter portraying the partitioning of the two halves.

The present invention in its preferred embodiment is comprised most generally of a comforter 10, which is square so as to be easily oriented in any of four directions comfortably and with equal coverage, and is comprised most generally of a sheet fabric casing 20 illustrated best in the cross-sectional diagram in FIG. 3; internal stitching 11 partitioning the comforter into two distinct halves 12 and 13 (visibility of dotted line referring to stitching 11 in FIGS. 1 and 2 for illustrative purposes only); and each of said halves 12 and 13 filled with two distinct fillers 21 and 22, which are different in heat retention but similar in loft and thus outward appearance to the user.

Said side 12 is filled with any filler material which has a high heat retentive quality, while the other said side 13 is filled with a filler material which has a less heat retentive quality than said side 12. These said fillers 21 and 22 may consist of the same material as one another, with said filler 21 being in a more compact, or denser, state than said filler 22 yet with a similar loft as said filler 22. An example is to use cotton bonded batting with a high density woven together tightly to be used as said filler 21 and a lighter cotton bonded batting woven together loosely to be used as said filler 22. Constructing batting to be more or less close-knit to produce a denser or lighter state, yet similar loft is common, and means for creating such batting would be obvious to anyone skilled in the art to which the present invention pertains. Alternatively, said fillers 21 and 22 may consist of materials different from one another, such as a cotton polyester blend batting for said filler 21 and a purely cotton batting of similar loft for said filler 22 since polyester provides greater warmth retentiveness than cotton, or said filler 21 may even consist of wool filling and said filler 22 consist of down. Any such fill may be used, provided that said filler 21 is of similar loft to that of said filler 22 yet of greater warmth retentiveness. At the joining edge of said two halves 12 and 13, said fillers 21 and 22 are stitched together 11 so as to prevent the shifting of each said filler 21 and 22 to opposite said halves 12 and 13. The method for separating said two halves 12 and 13 is internal within said sheet casing 20 so as to not be visible from the outside of the comforter, and does not noticeably increase or decrease the thickness along said joining line 11. An example of such a method is the feathering of one said filler 21 or 22 and the overlapping underneath and above the other said filler 21 or 22, and stitching 11 both joining and separating said two halves 12 and 13.

Figure 1:
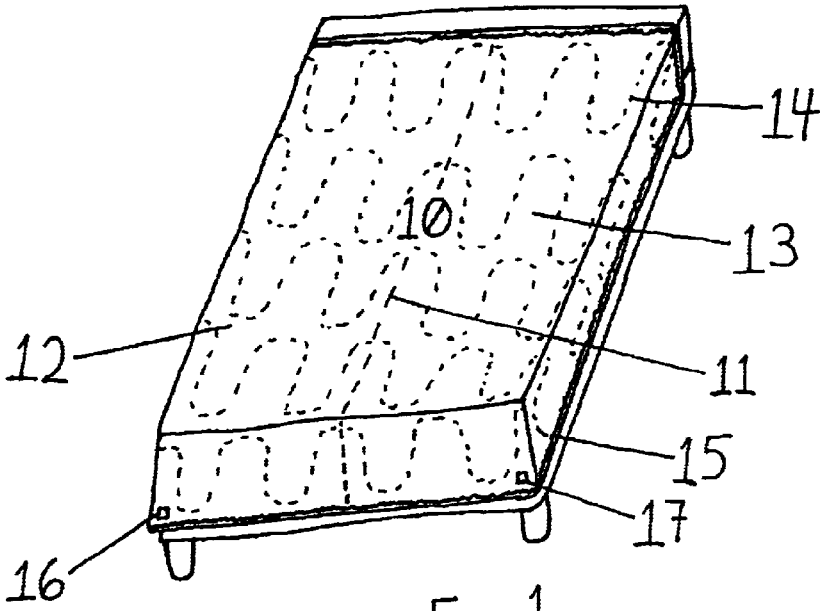
FIG. 1 is a perspective view of the comforter in its preferred embodiment, as it would appear covering a standard Queen mattress, with dimensions equivalent to actual measurements, with comforter oriented so as to provide differing thermal characteristics to the left and right halves.

In the preferred embodiment, said comforter 10 is stitched in a somewhat loose design pattern 14 such as that which is illustrated in FIGS. 1 and 2. The S-stitched pattern shown in FIGS. 1 and 2 is only exemplary of the many stitching patterns which could be utilized. Another tessellated stitching pattern such as a baffle-wall stitch in the shape of a box, diamond or hexagon would work just as well. Said stitching 14 secures the top and bottom cloths of said sheet casing 20 together with said fillers 21 and 22 so that they are altogether prevented from shifting.

Said sheet casing 20 is sewn around its perimeter 15 in a suitable method such as that which is illustrated in FIGS. 1 and 2, so as to retain the fillers 21 and 22 from escaping said comforter 10. In the preferred embodiment, tags 16 and 17 would be sewn to two different outside corners of said sheet casing, and would be preferably small so as to avert having attention drawn to them. Said tag 16 would indicate the side of greater warmth retentiveness, and would preferably be of a color such as dark blue, and said tag 17 would preferably be light blue, thus indicating its lesser warmth by its lighter color tone. It is preferred that on said tags 16 and 17, printed words would correspond to the color shade to further present which side is warmer than the other.

What is claimed as new is as follows:

1. A comforter of generally square shape, comprising:

a sheet casing comprising a top fabric panel and a bottom fabric panel joined together about their peripheral edges, said sheet casing being filled from outside edge to outside edge by two distinct filler materials, the first of said filler materials retaining heat to a higher degree than the second said filler material and both said filler materials yielding similar volumetric thickness, the first said filler material being permanently affixed within a first rectangular area, and second said filler material permanently affixed within a second rectangular area opposite of and similar in shape and size to said first rectangular area, both said filler materials affixed within their respective areas by a pattern of stitching running through said sheet casing as well as said filler materials.

2. A comforter as set forth in claim 1, wherein the peripheral edge of either said filler material where it meets the near edge of said other filler material is feathered into two halves, half of said feathering being apportioned over the top of said other edge of said other filler material and the other half being apportioned underneath said other edge, a line of stitching being sewn through this line of joining for said filler materials, which provides a constant line which prevents bunching, separation or shifting of one said filler material from its own said rectangular area within the sheet casing to other said rectangular area without said means being visible from the outside of said sheet casing.

3. A comforter as set forth in claim 1, wherein two tags or labels are affixed to said comforter, the first said label being affixed near an outside corner of said comforter containing said warmer filler material, and second said label being affixed near an outside corner of said comforter containing said filler material of less warmth retentive value, said first label indicating the greater warmth retentiveness of said portion which it is affixed to by being a darker color than said second label.

4. A comforter as set forth in claim 1, wherein one said filler materials consists of cotton batting with a high density machined to have a low loft for its density, while the other filler material also consists of cotton yet with a lower density machined to have a high loft for its density, thus providing for a warmer portion of said comforter underneath said more dense filler than that underneath said less dense filler, while maintaining an even loft across the entire comforter.

5. A comforter as set forth in claim 1, wherein one said filler material consists of a batting with a cotton polyester mix, and other said filler material consists of a purely cotton batting with a similar loft to that of said polyester batting, thus providing for a warmer portion of said comforter underneath said cotton polyester mix batting than that underneath said purely cotton batting, while maintaining an even loft across the entire comforter.

6. A comforter as set forth in claim 1, wherein both said panels of said sheet casing consist of a cotton blend fiber, such as cotton and silk.

7. A comforter as set forth in claim 1, wherein both said panels of said sheet casing consist of cotton.

8. A comforter as set forth in claim 1, wherein one of said filler materials consists of a wool fill, and other said filler material consists of down with a loft similar to that of said wool fill, providing for a warmer portion of said comforter underneath said wool fill than that underneath said down fill, while maintaining an even loft across the entire comforter.

* * * * *